US005269613A

United States Patent [19]

Olson et al.

[11] Patent Number: 5,269,613

[45] Date of Patent: Dec. 14, 1993

[54] PAPER HANDLING SYSTEM FOR PRINTERS

[75] Inventors: Allan G. Olson, Camas; Steve O. Rasmussen, Vancouver, both of Wash.

[73] Assignee: Hewlett-Packard Company, Palo Alto, Calif.

[21] Appl. No.: 954,619

[22] Filed: Sep. 29, 1992

[51] Int. Cl.[5] ..... B41J 19/76

[52] U.S. Cl. ..... 400/569; 400/624; 400/314; 400/315; 271/184

[58] Field of Search ..... 400/283, 569, 305, 314, 400/315, 356, 185, 328, 624, 625, 626, 627, 628, 629, 578, 602; 271/184, 902

[56] References Cited

U.S. PATENT DOCUMENTS 4,480,825 11/1984 Landa ..... 271/184
4,616,819 10/1986 Makio et al. ..... 271/902
5,000,594 3/1991 Beehler et al. ..... 400/569
5,188,353 2/1993 Parks ..... 271/184
5,226,743 7/1993 Jackson et al. ..... 400/185

*Primary Examiner*—Eugene H. Eickholt

[57] ABSTRACT

A paper handling system is provided which allows for controlled passage of a pivot between a normally biased initial position and a task-performing position. The pivot includes a sheet-directing member and a track which is fixed relative to the sheet-directing member and is movable to the task-performing position in opposition to pivot bias. A follower, which is configured for selected travel along the track, selectively applies a force against the track in opposition to biased sheet-directing member movement. A processor-controlled printhead carriage is used to trigger and then to regulate pivot rotation.

7 Claims, 5 Drawing Sheets

PAPER HANDLING SYSTEM FOR PRINTERS

TECHNICAL FIELD

The present invention relates generally to a system for use in selectively directing performance of various tasks by a printer, such as picking up, kicking out, and printing on paper sheets. More particularly, the invention relates to a paper handling system which employs a mechanism which is controllably movable between plural positions so as to controllably trigger execution of desired printer tasks.

BACKGROUND ART

In order to operate effectively, printers must be able to perform various tasks during a print cycle, including picking up a sheet of paper, feeding it through the printer, and then kicking it out through the printer's output port. Such tasks are generally accomplished using a plurality of motor-driven gear trains, each such train being configured to execute a different one of the defined tasks. A problem with this arrangement, however, is that it requires the use of numerous, complex and costly gear mechanisms, driving the price of most single-sheet printers beyond the budgetary limits of many potential printer purchasers.

One cost-saving approach to this problem has involved the use of a clutch which is selectively engagable with a single, motor-driven gear to bring about execution of each of the various tasks. An example of such an arrangement is set forth in U.S. Pat. No. 5,000,594, which names Beehler et al. as inventors and which is commonly owned herewith. In that patent, the inventors describe a clutch which is attached to a cam-like pivot, the pivot being used to direct a sheet of paper through a conventional print cycle. Upon engagement with the gear, the clutch drives the pivot from a spring-biased initial position to a task-performing position wherein the pivot directs execution of a particular task. Once the directed task is completed, the clutch is disengaged, allowing the pivot to return under spring bias to its initial position so that another task may be performed.

Although the just-described arrangement has simplified the mechanism required to perform conventional printer tasks, it has left room for further improvements. For example, one area of difficulty concerns the rate at which the pivot returns to its initial position once a task has been performed. Known printers have provided for unrestrained spring-biased return of the pivot to the first position, such return being halted only by collision of the pivot or clutch with a static stop. Such collision, in turn, has led to excessive stresses on the components involved and to an undesirable clanking sound. Additionally, pivot return in known printers cannot be stopped until the pivot reaches its initial position, potentially leading to missed opportunities of saved time or energy between the performance of consecutive tasks.

DISCLOSURE OF THE INVENTION

The invented paper handling system addresses the above-identified problems by using mechanism designed to allow for controlled passage of a pivot between an initial position and a task-performing position. Toward this end, the system's pivot includes a sheet-directing member and a track which is fixed relative thereto. The system also includes a follower which selectively is configured to travel controllably along the track. The pivot, which is normally biased toward the initial position, selectively is moved toward the task-performing position using a drive mechanism capable of overcoming the bias force. Movement in the opposite direction is controlled using the follower, such follower selectively being directed to apply a force against the track in opposition to the bias force. In the preferred embodiment, the applied force is controllably variable allowing for regulation of the rate at which the pivot returns to its initial position.

DETAILED DESCRIPTION AND BEST MODE FOR CARRYING OUT THE INVENTION

Figure 1:
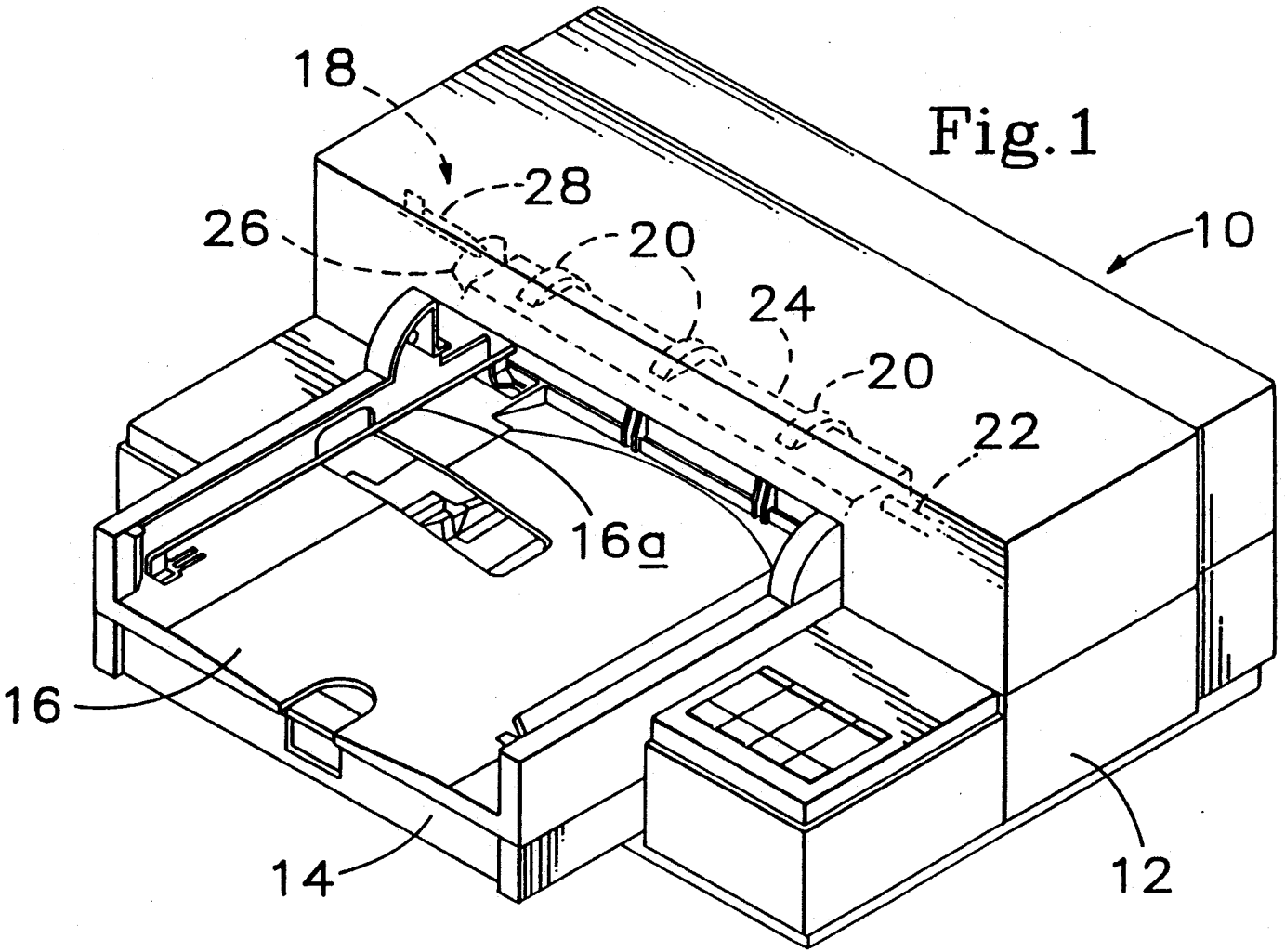
FIG. 1 is an isometric view of a single-sheet printer, such printer employing the sheet handling system of the present invention as shown generally in dashed lines.

As stated above, the invented system is suitable for use in virtually any printer wherein it is desired to perform a variety of different printing tasks. The system, however, has proven particularly useful in single-sheet printers, such printers generally requiring that picking, kicking, and printing operations be performed. These tasks, it will be appreciated, lend themselves to execution by the type of system which will now be described. A single-sheet printer is thus depicted in FIG. 1 at 10, such printer providing the context in which the invented system is herein described.

Printer 10, it will be noted, includes a chassis 12, a paper input tray 14, and a paper output tray 16. The printer, which may also include other standard elements well known in the art, is capable of performing a series of different tasks on a sheet of paper, such tasks constituting what is known as a print cycle. During a conventional print cycle, for example, paper is picked up from the input tray, printed on, and then kicked out (i.e. expelled) to the output tray. These operations are effected using a sheet handling system, one such system being shown generally by dashed lines at 18. As indicated, system 18 includes a plurality of spaced rollers 20, each of which is operatively connected to a motor-driven drive shaft 22. The system also includes a pivot 24, the pivot selectively being rotatably movable to various positions wherein various printer tasks are performed. As will be explained below, pivot rotation is controllably effected using a clutch 26 and a clutch-actuator/follower 28.

Sheet handling system 18 is shown more specifically in FIGS. 2–5, such drawings illustrating execution of a particular task (namely sheet kicking). As indicated, task operation is effected by rotating pivot 24 from its initial position (shown in FIG. 2) to a first task-performing position (shown in FIG. 4), at which point the task is performed. The pivot is then rotated back to its initial position so that a new task operation may begin. In the depicted embodiment, such first task-performing position corresponds to the pivot position wherein sheet kicking occurs and the initial position corresponds to the pivot position wherein sheet printing occurs. It should be appreciated, however, that the depicted system also provides for pivot rotation to a second task-performing position wherein sheet picking occurs.

Figure 2:
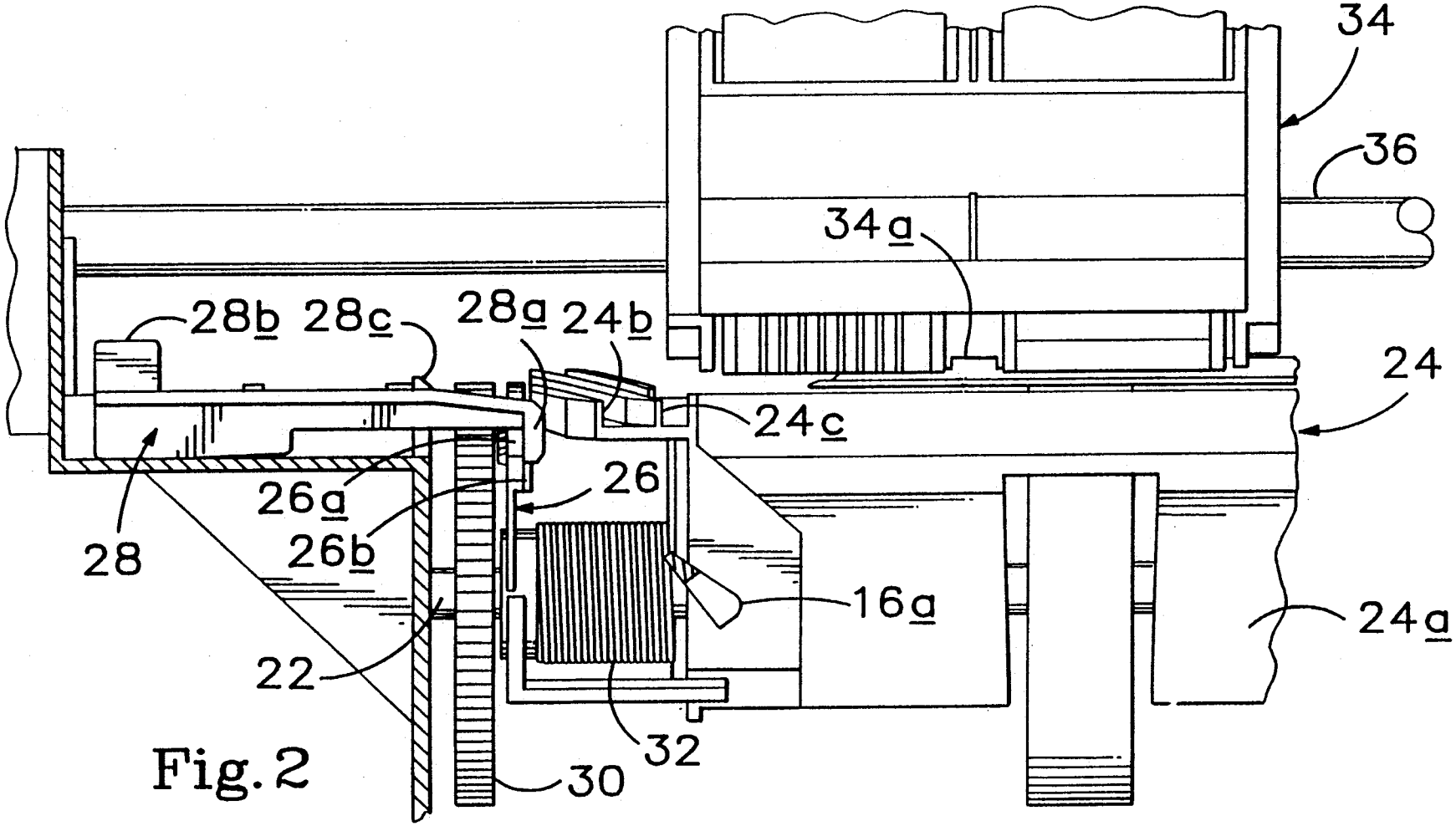
FIG. 2 is an enlarged environmental view showing the printer in the vicinity of the invented system with the printer's pivot positioned in its initial position.
Figure 3:
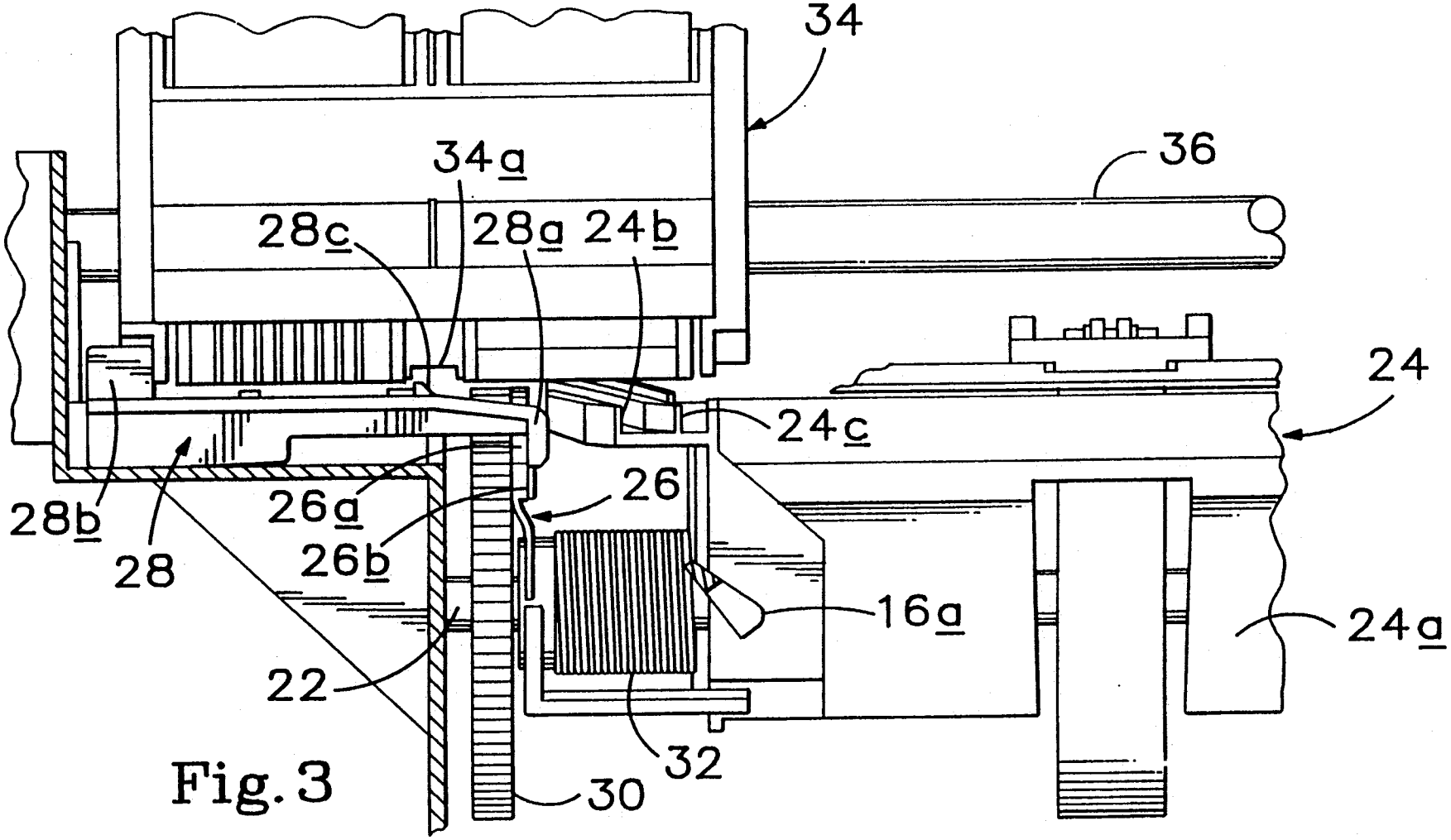
FIG. 3 shows the invented system with a clutch having been actuated so as to engage a motor-driven gear.
Figure 4:
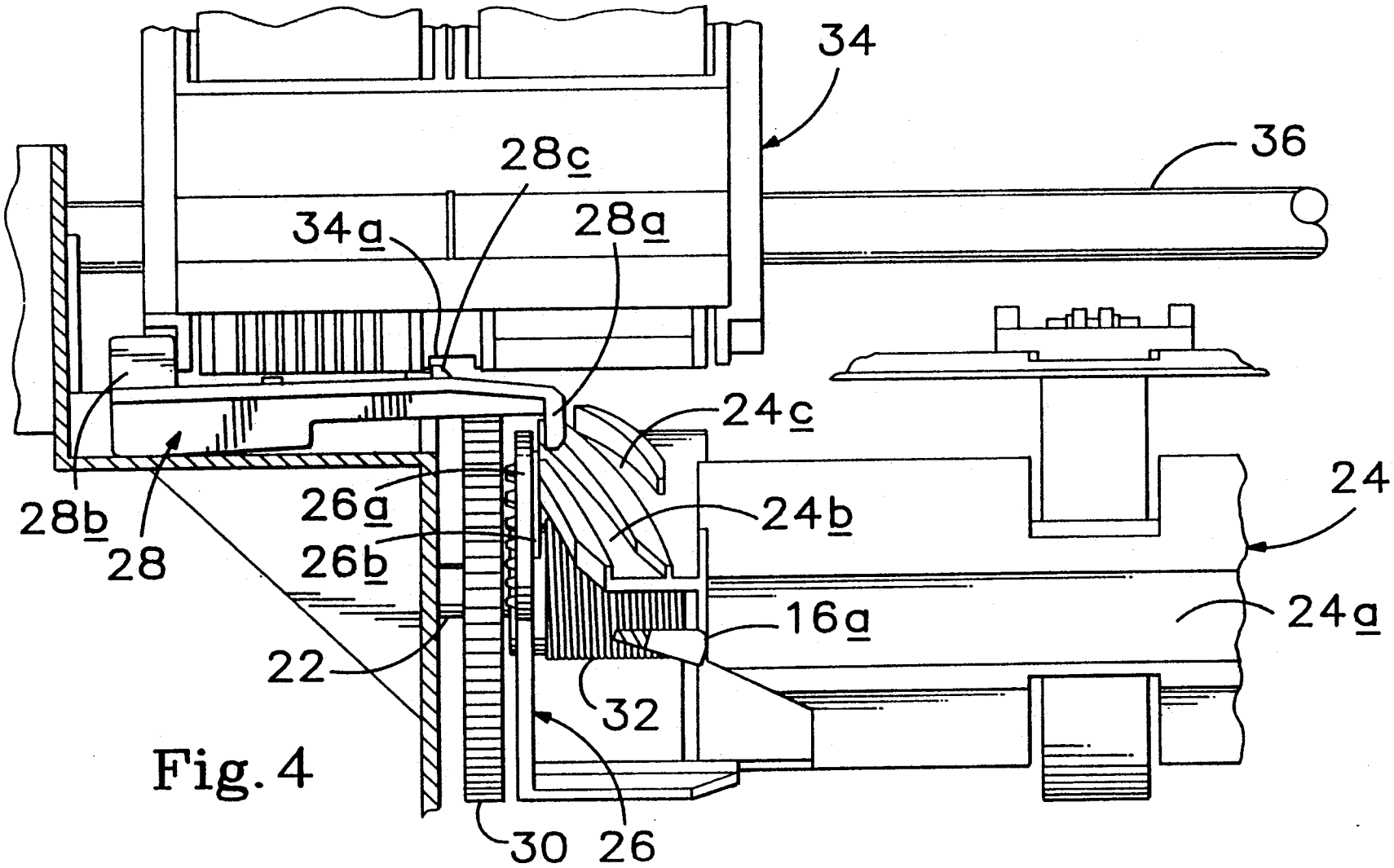
FIG. 4 shows the invented system with the printer's pivot in a first task-performing position.

Focusing initially on rotation of the pivot from its initial position to its first task-performing position, and referring for this purpose specifically to FIGS. 2–4, it will be appreciated that such rotation is effected by controlled flex of clutch 26. As shown, the clutch is fixedly secured to the pivot and is rotatably mounted to shaft 22 so as to provide for rotation of the clutch and pivot in concert. Such rotation, as described in U.S. Pat. No. 5,000,594, is effected by exerting a force against a clutch protrusion 26*a* so as to direct the clutch into resilient mating engagement with a motor-driven gear 30. The motor-driven gear, which acts as the system's drive mechanism, and the clutch which is secured to the pivot, include a plurality of selectively interlocking teeth, providing for selected rotation of the pivot along with rotation of the gear. In this manner, the pivot is rotated from the initial position to the task-performing position, at which point the clutch is directed to disengage the gear so that the pivot may be returned to its initial position.

Turning now to a specific description of the printer's pivot 24, the component which directs a sheet of paper through the various printer tasks, it will be noted that such pivots includes a cam-like sheet-directing member 24*a* and a pair of elongate tracks 24*b*, 24*c*. The sheet-directing member extends substantially across the printer's chassis adjacent its input and output ports. Member 24*a* is rotatable about shaft 22, such rotation being effective in directing passage of paper sheets into or out of the printer by camming action with the appropriate input or output tray. As shown in FIGS. 2–5, for example, cam member rotation from the initial position to the first task-performing position results in a camming action with a wing 16*a* (shown more completely in FIG. 1), such wing being used to effect stacking of sheets on the printer's output tray as described in a corresponding U.S. patent application entitled "Paper Stacking System for Printers" U.S. Ser. No. 07/954,781 which names Pearo et al. as inventors and which is commonly owned herewith. As indicated, pivot 24 effects rotation of the wing as it moves toward its first task-performing position.

As indicated generally in FIGS. 2–5, but as best shown in FIG. 4, tracks 24*b* and 24*c* are fixed relative to the sheet-supporting member, each track being used during execution of a particular task as will be described below. In the depicted system, track 24*b* is used during sheet kicking and track 24*c* is used during sheet picking. The tracks, it will be noted, are defined by a series of upstanding ridges, each such ridge including a pair of generally upright side walls. The ridges extend generally angularly across the pivot so as to define a pair of sideways-adjacent grooves. As will be appreciated upon reading further, the tracks are used during biased rotation of the pivot to control passage of the same to its initial position. The tracks are each of a predetermined length, the length of each track corresponding substantially to the distance traveled by the periphery of the pivot adjacent that track as the pivot moves from a task-performing position to the initial position.

Upon further review of FIGS. 2–5, the reader will note that the pivot is yieldably biased toward its initial position via a bias element 32 such as a spring. The spring is secured to the clutch, which in turn in rotatable to a degree defined by a suitably positioned static stop (not shown). The stop restricts spring-biased rotation of the clutch/pivot combination, operatively preventing rotation thereof beyond the normally biased initial position shown in FIG. 2. As suggested by the pivot progression described above, spring-bias selectively is overcome by engagement of the clutch with gear 30 and may be opposed by other printer mechanism as will now be described.

Figure 5:
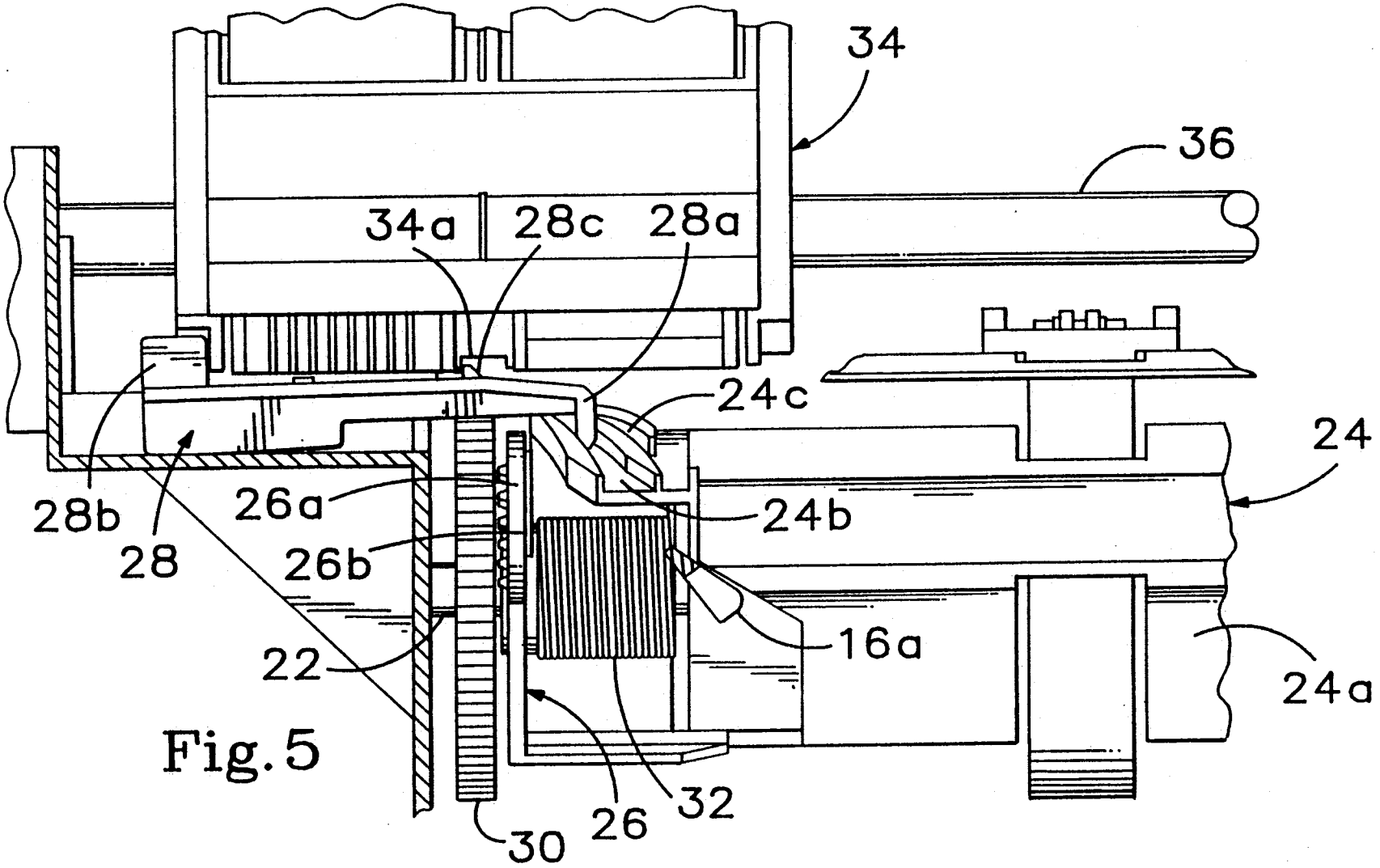
FIG. 5 shows the invented system at a moment during return of the pivot to its initial position.

In FIGS. 3–5, pivot rotation is shown, control of such pivot rotation being effected using a clutch-actuator/-follower 28. Such component, it will be appreciated, is operable selectively either as a clutch actuator wherein it urges clutch 26 into engagement with gear 30 (FIG. 3), or as a follower wherein it travels along one of the pivot's tracks to effect controlled pivot return (FIG. 5). To accomplish such control, component 28, hereinafter referred to simply as a follower, is provided with a first finger 28*a*, a second finger 28*b*, and a central projection 28*c*.

Follower 28 is preferably slidably mounted to the printer's chassis 12 so as to allow for arrangement of the follower in alternative configurations. In a first configuration, shown in FIG. 3, finger 28*a* contacts clutch protrusion 26*a*, urging the clutch in to engagement with gear 30. As the clutch turns with the pivot under the direction of gear 30, the follower is tilted. Such tilt is due, at least partially, to camming contact of the same against a clutch ridge 26*b* which is positioned on clutch protrusion 26*a*. As shown in FIG. 5, the follower may also be positioned in a second configuration wherein finger 28*a* is urged into engagement with a side of one of the ridges which define the pivot's tracks. In either case, the follower acts to control movement of the pivot by applying a force to a component which moves relative thereto.

As shown in FIG. 3, a force substantially paralleling the shaft 22 may be supplied operatively by a printhead carriage 34, such carriage being mounted to reciprocate on a carriage shaft 36. The carriage, it will be appreciated, includes one or more printheads whereby images are printed on a sheet of paper. As is conventional in most printer applications, the carriage is preferably motor-driven and processor or microprocessor controlled, allowing for corresponding control of pivot rotation as will now be described.

Under processor control, the carriage is directed selectively into contact with the follower's second finger 28*b*, effecting passage of the follower into contact with clutch 26. The clutch flexes under the force applied by the follower, bringing the clutch teeth into engagement with the corresponding teeth on gear 30. Because there is considerable play in the realationship between the follower and the chassis, and because of the first finger's relationship with clutch ridge 26*b*, the follower tends to tilt counterclockwise as shown in FIGS. 4 and 5. Central projection 28*c* is thus placed into mating contact with a corresponding recess 34*a* in carriage 34 and the carriage and follower are momentarily locked together.

The follower, as shown in FIG. 4, is then carried back toward its initial position under the direction of the processor controlled carriage. The first finger 28*a* is eventually aligned with one of the tracks (track 24*b* in the depicted sequence) and passed controlledly therethrough (shown in FIG. 5). As will be appreciated upon reference to the drawings, movement of the follower in the manner just described results in a corresponding disengagement of the clutch from the motor-driven gear. The pivot will thus, in the absence of other forces which will be described below, pass readily to its initial position due to the applied spring bias.

Turning now to FIG. 5, and considering in detail the return of the pivot to its initial position, it will be appreciated that such return is opposed by forces resulting from the follower's engagement with track 24*b*. As indicated, rotation of the pivot results in the follower's finger 28*a* contacting one of the ridges which define track 24*b*. The ridge will thus act as an impediment to pivot rotation, any given position along the ridge's length being suitable to act as a stop. The present arrangement therefore allows for stopping of the pivot's rotation at any point during pivot return. Pivot rotation is possible only as the follower is allowed by the carriage to slide down the track.

In view of the just-described arrangement, it should be appreciated that the rate at which the pivot returns to its initial position may also be controlled. Such rate, it will be noted is related to the angulation of the track and the rate at which the follower is allowed to move along the track. Because the carriage is processor controlled, and because it is the carriage which determines how far the follower may move, it is possible straightforwardly to control the rate of pivot movement via suitable programming of the processor. The rate of return, it will be understood, may also be affected by the properties of the materials used to form both the tracks and the follower, such properties being at least partially determinative of frictional forces involved.

INDUSTRIAL APPLICABILITY

Conventional printers typically employ mechanism such as a printhead carriage which is driven back and forth during the printer's print cycle. Such mechanism, it will be understood, may be used to controlledly actuate movement of the pivot so as to trigger different tasks as described above. The invented system is therefore applicable to virtually any printer which employs a mechanism such as a printhead carriage and is intended to perform tasks such as the picking, printing, and kicking of paper. While the best mode and preferred embodiment of the invention have been set forth herein, it should be appreciated that variations and modifications may be made without departing from the scope of the invention as defined by the claims.

We claim:

1. In a printer, a sheet handling system comprising:

a sheet-directing member selectively movable between an initial position and a task-performing position;

a bias element yieldable urging said sheet-directing member toward said initial position:

a track fixed relative to said sheet-directing member and movable therewith; and a follower configured for selected frictional engagement with said track to oppose biased movement of said sheet-directing member toward said initial position.

2. The system of claim 1 further comprising a motor-driven carriage, said follower selectively being urged into engagement with said track by said carriage.

3. The system of claim 2, wherein said motor-driven carriage selectively engages said follower to produce a frictional force between said follower and said track to oppose movement of said sheet-directing member, said frictional force being regulated by said motor-driven carriage.

4. The system of claim 3, wherein said frictional force produced by said motor-driven carriage is variable.

5. The system of claim 2, wherein said motor-driven carriage is processor controlled.

6. The system of claim 1, wherein said track is in the form of a groove suited for sliding capture of said follower.

7. In a printer, a sheet handling system which selectively directs picking, kicking, and printing of a sheet, said system comprising:

a pivot including a sheet-directing member and a pair of tracks fixed relative to said member, said sheet-directing member being pivotable between picking, kicking, and printing positions;

a bias element yieldably urging said sheet-directing member toward said printing position;

a drive mechanism configured selectively to drive said sheet-directing member from said printing position to one of said other positions, said drive mechanism, after said sheet-directing member reaches one of said other positions, selectively allowing biased rotation of said member back to said printing position; and a follower configured to selectively engage one of said tracks to regulate rotation of said sheet-directing member back to said printing position.

* * * * *